United States Patent [19]

Häfele

[11] Patent Number: 4,728,269

[45] Date of Patent: Mar. 1, 1988

[54] FUEL INJECTION PUMP FOR INTERNAL COMBUSTION ENGINES

[75] Inventor: Walter Häfele, Fellbach, Fed. Rep. of Germany

[73] Assignee: Robert Bosch GmbH, Stuttgart, Fed. Rep. of Germany

[21] Appl. No.: 929,864

[22] Filed: Nov. 13, 1986

[30] Foreign Application Priority Data

Feb. 18, 1986 [DE] Fed. Rep. of Germany ..... 3605056

[51] Int. Cl.[4] ..... F04B 7/04; F04B 39/10

[52] U.S. Cl. ..... 417/490

[58] Field of Search ..... 417/490; 123/90.48, 123/90.49

[56] References Cited

U.S. PATENT DOCUMENTS 3,311,062 3/1967 Knapp ..... 417/494
4,335,685 6/1982 Clouse ..... 123/90.49
4,519,299 5/1985 Moloney ..... 417/490

FOREIGN PATENT DOCUMENTS 201352 12/1958 Austria .
3128544 2/1983 Fed. Rep. of Germany .
2103724 2/1983 United Kingdom .

*Primary Examiner*—Carlton R. Croyle
*Assistant Examiner*—Jane E. Obee
*Attorney, Agent, or Firm*—Edwin E. Greigg

[57] ABSTRACT

A fuel injection pump for internal combustion engines has a pump piston which via a pressure plate rests with a piston bottom on an axially driven tappet with slight play. This contact is brought about by a pressure spring, which is supported on a spring plate so as to grip the piston bottom from behind. To prevent the pressure plate from falling out if the pump piston should become stuck, the spring plate is cup-shaped and includes a cylindrical cup portion having two projecting protrusions. The pressure plate has a radial flange adapted to rest on the projecting protrusions. Those protrusions and the radial flange are adapted to one another such that the pressure plate can be introduced in a predetermined position through the protrusions. The piston bottom located between the pressure plate and the plate bottom of the spring plate prevents the pressure plate from being able to assume a position, after assembly, in which it could slip and escape back outwardly through those protrusions.

7 Claims, 10 Drawing Figures

FUEL INJECTION PUMP FOR INTERNAL COMBUSTION ENGINES

BACKGROUND OF THE INVENTION

The invention is directed to improvements in fuel injection pumps for internal combustion engines.

In such fuel injection pumps, the pressure plate serves to define the spacing between the tappet and the piston bottom of the pump piston, and optionally also to adjust the supply onset of the fuel injection pump; to reduce wear, the pressure plate is made of highly wear-resistant steel, such as that also used for the pump piston.

In a known fuel injection pump of the above-mentioned type (German Offenlegungsschrift No. 31 28 544), the pressure plate is retained in a centered and positive manner, on the underside of the spring plate facing the tappet, by the pressure spring. If the pump piston should stick in its top dead center position because of some malfunction effecting an attendant lifting of the pump piston tappet, which the cam continues to move back and forth, then the pressure plate may drop out of its centered position on the underside of the spring plate and cause damage to the injection pump.

In another known fuel injection pump (Austrian Pat. No. 201 352), to avoid this threat of damage to the pump, the piston bottom is seated in the pressure plate, which has a recess for this purpose and a cutout for receiving the piston bottom. The top of the pressure plate is widened and serves to replace the spring plate as the bearing surface for the pressure spring.

This kind of pressure plate is not economical to manufacture and thus is not a very suitable spare part, especially where many of various thicknesses, have to be kept on hand to adapt to the varying spacing between the tappet and the piston bottom. In the known fuel injection pump, an additional auxiliary shim has therefore been inserted, with a variable thickness depending on the tolerance that needs to be compensated for, in between the pressure plate and the tappet. This auxiliary shim is embodied as a spring clip, which is introduced into the tappet via a lateral recess that is accessible from the outside; in the inserted state, the spring clip is braced on its circumference on the tappet. This prevents the auxiliary skim from falling out if the pump piston should stick at top dead center. Overall, this known injection pump is of an impractical construction and thus it is difficult to assemble.

OBJECT AND SUMMARY OF THE INVENTION

The fuel injection pump according to the invention has the advantage that with structurally simple means, the pressure plate is secured against falling out. Additional auxiliary parts or position-securing elements are dispensed with. This reduces the number of individual parts and lessens the expense of assembly. The spring plate can be manufactured as a simple stamped part, and the securing protrusions are cut out from the spring plate itself and bent away from it. The spring plate and the pressure plate are easily mounted. In the installed position, they fasten themselves in position, so that no additional provisions need to be made.

Herein disclosed are further advantageous embodiments and improvements in the fuel injection pump according to the invention.

In one advantageous embodiment shown in the drawing, the pressure plate comprises an economical turned part, which can be made without extra machining operations. Because of the disposition of the protrusions in the spring plate, the pressure plate can be readily guided in an inclined position into the spring plate through its open side and through the protrusions, while the pump piston is still disassembled; later, the collar rests on the two protrusions. Once the piston bottom has been introduced into its cup-shaped interior, the pressure plate is prevented from resuming an inclined position, so that it cannot drop out through the protrusions. The pressure plate is thus reliably secured from falling out of the pressure plate, regardless of the position the pump piston and tappet assume.

Still another advantageous embodiment of the invention is that the protrusions for locking the pressure plate in the spring plate are easy to manufacture.

Yet another advantageous embodiment of the invention is to provide for a piston bottom insertion opening in the cup-shaped spring plate, for then the spring plate provided with the pressure plate can easily be pushed via the piston bottom onto the pump piston, where it locks itself, under the influence of the pressure spring.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
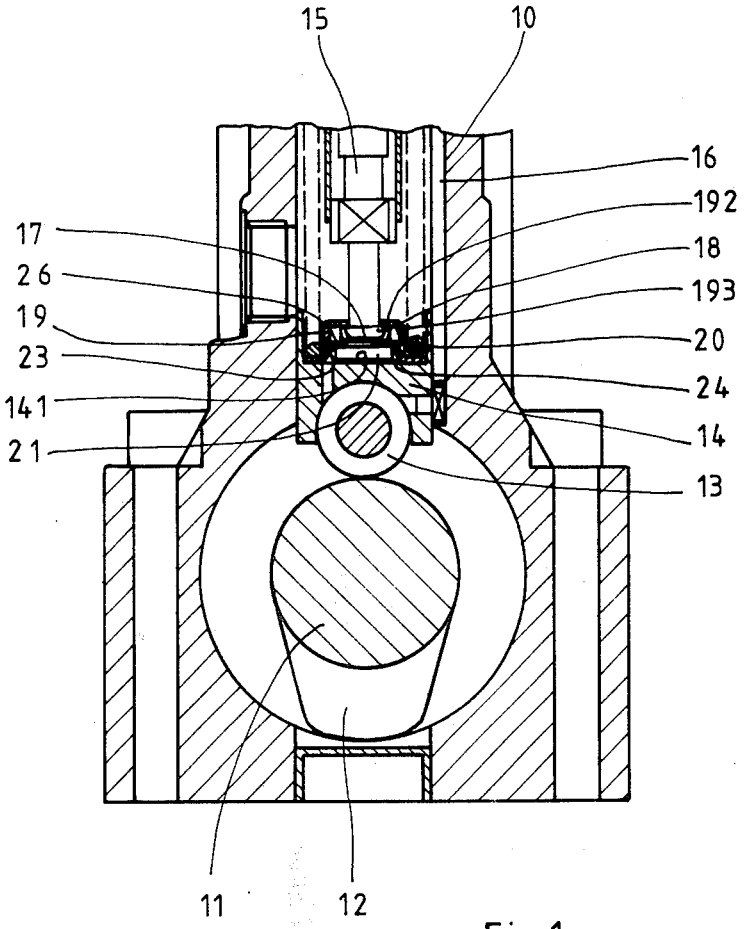
FIG. 1 is a fragmentary longitudinal section through a portion of a fuel injection pump in the general area of the cam shaft.

The fuel injection pump shown in part in FIG. 1 in a longitudinal section has a housing 10, a shaft 11 supported in the housing and having at least one cam 12 mounted on it such that it rotates fixedly with it; the cam 12 is in engagement via a roller 13 with a tappet 14 for driving a pump piston 15. The tappet 14 is axially displaceably guided in a bore 16 of the housing 10. Of the pump piston 15, which with a pump cylinder (not shown) disposed in the housing 10 encloses a pressure or work chamber, only its lower portion is shown, which is defined by a piston bottom 17. The piston bottom 17 has a radially protruding annular flange 18, which together with the piston bottom is flattened on two diametrically opposed sides. The annular flange 18 is gripped from behind by a spring plate 19, which is curved outward in a cup-like manner. A pressure spring 20, embodied as a compression spring, rests on a lip of the cup rim 191 of the spring plate 19 and is supported on the housing. A pressure plate 21 is disposed between the piston bottom 17 and the tappet 14. By means of the pressure spring 20, the spring plate 19 is pressed against the tappet bottom 141, and upon the compression stroke the piston bottom 17 rests positively, via the pressure plate 21, against the tappet bottom 141. The axial height or thickness of the pressure plate 21 spans the spacing between the tappet bottom 141 and the piston bottom 17, leaving a slight axial play, which is required so that the pump piston 15 can rotate to vary the supply quantity.

Figure 3:
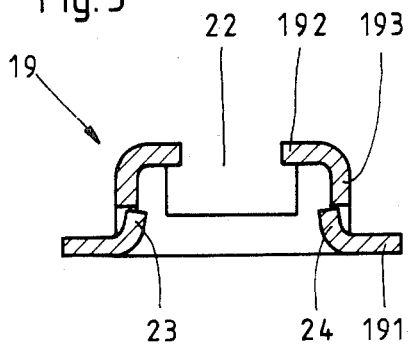
FIG. 3 is a cross-sectional view taken along the line III—III of FIG. 2.
Figure 4:
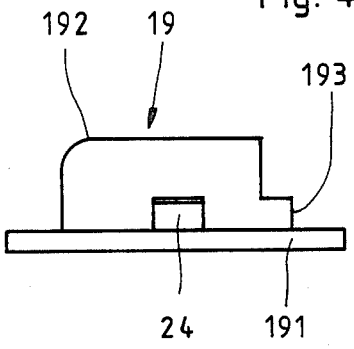
FIG. 4 is a side elevational view of the spring plate in the direction of the arrow IV of FIG. 2.
Figure 2:
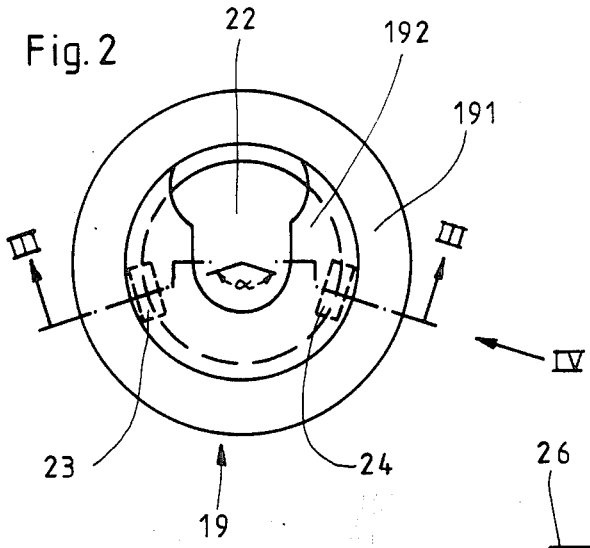
FIG. 2, on a larger scale, is a top plan view of a spring plate of the fuel injection pump of FIG. 1.
Figure 5:
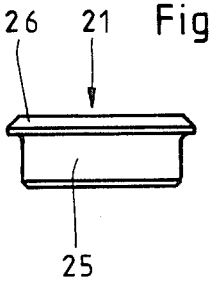
FIG. 5 is a side view of a pressure plate of the fuel injection pump of FIG. 1.
Figure 7:
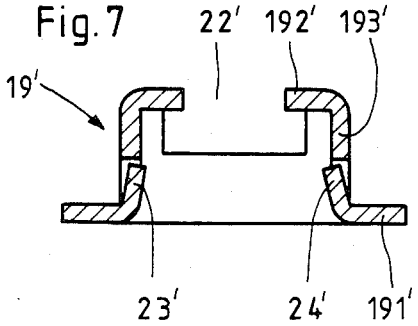
FIG. 7 is a cross-sectional view taken along the line VII—VII of FIG. 6.
Figure 8:
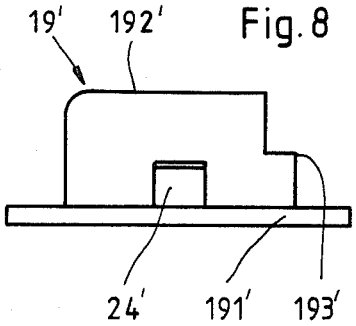
FIG. 8 is an elevational view of the spring plate taken along the arrow VIII of FIG. 6.

The spring plate 19 is shown on a larger scale in FIGS. 2–4, and the pressure plate 21 is shown on a larger scale in FIG. 5. In FIGS. 3 and 4, the cup-like outward curve of the spring plate 19 is clearly visible. On its bottom 192, the spring plate 19 has an assembly opening 22 for the insertion of the piston bottom 17 and annular flange 18 therethrough. As shown in FIG. 2, the assembly opening 22 is asymmetrical, with a small inside diameter in one extension direction and a substantially larger inside diameter in the extension direction at right angles to the first; these inside diameters are adapted to the dimensions of the piston bottom 17 and annular flange 18. At the inner wall of the cylindrical cup portion 193 of the spring plate 19, two protrusions 23, 24 project radially into the cup interior, being spaced apart from the cup bottom 192. The protrusions 23, 24 are embodied by tongues or lugs that are punched out from the cylindrical cup portion 193 (see FIG. 4) and then bent inwardly (FIG. 3). As FIG. 2 shows, the two protrusions 23, 24 are eccentrically disposed in such a manner that their respective longitudinal planes extending through the centers of the protrusions and through the axis of the cup form an obtuse angle with one another. The traces of these longitudinal planes extending through the protrusion centers and through the cup axis are shown in dot-dash lines in FIG. 2.

The pressure plate 21, which is shown in FIG. 5 on the correct scale with respect to the spring plate 19, is embodied as a diametrically symmetrical collar washer, which comprises a cylindrical washer 25 and a collar 26 integrally mounted theron and arranged to protrude from the circumference of the washer 25. The radius of the washer 25 is selected to be smaller than the inside radial spacing of the protrusions 23, 24 from the axis of the spring plate, while the outside diameter of the collar 26 is selected to be larger than the largest inside diameter between the protrusions 23, 24. In this manner, the pressure plate 21 can be introduced in an inclined position through the protrusions 23, 24 with its collar 26, beginning at the opening side of the cup-shaped spring plate 19 and then arranged to pass between the protrusions 23, 24 on the one hand and the cup bottom 192 on the other. After the pressure plate 21 assumes a horizontal orientation, the collar 26 rests on the protrusions 23, 24, while the cylindrical washer 25 protrudes downward, through the protrusions 23, 24. If the piston bottom 17, by being rotated, is now passed through the assembly opening 22, until the piston bottom 17 comes to rest in the interior of the cup and the cup bottom 192 grips the annular flange 18 from behind, then by means of the pressure spring 20 which now engages the underside of the cup rim 191, the cup bottom 192 is pressed against the annular flange 18 in the vicinity of the assembly opening 22. Thus by means of the piston bottom 17, the pressure plate 21 that rests against the protrusions 23, 24 is fixed in this position; it can no longer tilt into an inclined position and thus cannot become disengaged from its affixation on the protrusions 23, 24, even if the positive engagement between the spring plate 19 and the tappet 14 is overcome because of sticking of the pump piston 15 in its top dead center position.

The spring plate 19' and the pressure plate 21' according to the further embodiment, which is shown in FIGS. 7–10, have been only slightly modified, so that identical components are identified by the same reference numeral, but with a prime to differentiate them.

Figure 6:
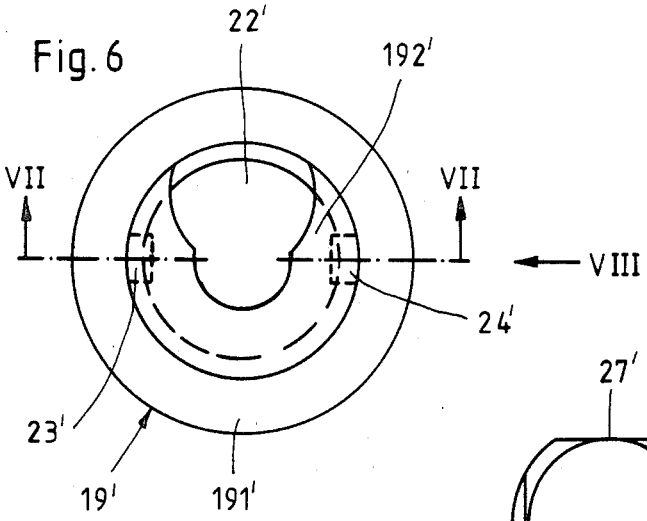
FIG. 6 is a top plan view of a further exemplary embodiment of a spring plate of the fuel injection pump of FIG. 1.
Figure 10:
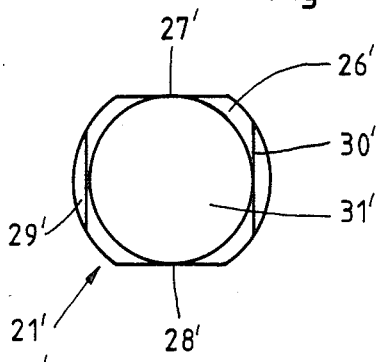
FIG. 10 is a view of the pressure plate of FIG. 9 from below.
Figure 9:
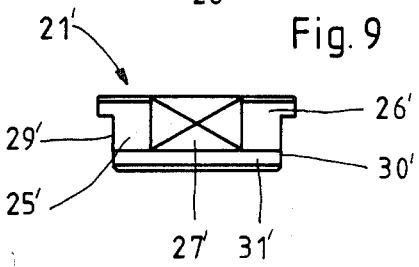
FIG. 9 is a side view of a further embodiment of pressure plate of the fuel injection pump of FIG. 1.

As FIG. 6 shows, the protrusions 23' and 24', which are cut away from the cylindrical cup part 193' in the same way in the form of lugs or tongues and bent into the interior of the cup, are centrally disposed and are diametrically opposite one another. Otherwise, the outwardly curved cup-shaped spring plate 19' is embodied identically with that shown in FIG. 2.

The pressure plate 21' shown in FIGS. 9 and 10 is again embodied as a rotationally symmetrical collar washer having a cylindrical washer 25' and an integral collar 26'. The collar 26' and the washer 25' are flattened on both diametrically opposed sides of the same extension direction, and additionally the washer 25' is additionally flattedd on both diametrically opposed sides of the extension direction at right angles to the first, symmetrically with the axis of the pressure plate 21; this flattening is done to a dimension which is slightly smaller than the inside distance between the protrusions 23', 24'. The result is the faces 27' and 28' on the washer 25' and collar 26', and the faces 29' and 30' on the washer 25' only.

On the end face opposite the collar 26', the washer 25' has a preformed cylindrical tang 31', the outside diameter of which is smaller than the inside spacing between the two protrusions 23', 24' in the spring plate 19'. The total axial height of the pressure plate 21' is selected to be greater than the spacing of the protrusions 23', 24' from the inside of the cup bottom 192', while the axial height of the washer 25' with the collar 26' is selected to be approximately equal to this above-defined dimension. When the pressure plate 21' is so embodied, it can be guided from the open side of the spring plate 19' via the two faces 27' and 28' through the protrusions 23' and 24', as far as the inside of the cup bottom 192'. In this position, only the cylindrical tang 31' is located between the protrusions 23' and 24'. After the pressure plate 21' is rotated by 90°, it can be retracted via the faces 29' and 30' of the washer 25' until the collar 26' rests on both protrusions 23' and 24'. By means of the faces 29' and 30', which rest on the protrusions 23' and 24, rotation of the pressure plate 21' is reliably prevented. By means of the piston bottom 17 which is guided through the assembly opening 22', axial displacement of the pressure plate 21' is prevented. As in the exemplary embodiment of FIG. 5, in the pressure plate 21' as well, the outside diameter of the collar 26' is selected to be smaller than the inside diameter of the cylindrical cup part 193' of the spring plate 19' and larger than the inside spacing between the protrusions 23' and 24'.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A fuel injection pump for internal combustion engines, having at least one axially displaceable pump piston including a tappet, which reciprocates by means of a cam for driving the pump piston, and having a pressure spring for positively keeping the cam, tappet and pump piston in engagement, which pressure spring is supported at one end on the housing and at another end on a spring plate so as to grip an annular flange on a piston bottom of the pump piston the annular flange protruding radially therefrom and further having a pressure plate located in between the piston bottom and the tappet, characterized in that the spring plate has a, cup shape and a plate bottom thereof having an assembly aperture for insertion therethrough of the piston bottom and the annular flange, the piston bottom being arranged to rest in a cup-shaped interior of said spring plate while the plate bottom grips the annular flange, that at least two inwardly-projecting protrusions project from an inner wall defining a cylindrical cup portion, said protrusions being spaced apart from the spring plate bottom, and that the pressure plate is provided with a collar means on an end oriented toward the pressure plate bottom, a diametric extent of which collar means is smaller than an inside diameter of the cylindrical cup portion and greater than an internal radial spacing between the at least two protrusions, and a diameter of a body portion of the pressure plate is smaller than the interior radial spacing of the at least two protrusions from one another, whereby the body portion of the pressure plate may extend outwardly through the interior space between said protrusions while the collar means is retained thereon.

2. An injection pump as defined by claim 1, further characterized in that the pressure plate comprises a diametrically symmetrical washer, the collar means and body portion of which being of substantially cylindrical shape and said body portion having a radial extent smaller than the internal radial spacing of the at least two protrusions from an axis of the spring plate, and that said protrusions are eccentrically disposed radially of said spring plate as to define in a plane extending therethrough and normal to said axis an obtuse angle included therebetween, the pressure plate being adapted for introduction in an inclined position inwardly through an aperture of the spring plate, the collar being adapted to pass through and between the protrusions for retention adjacent the spring plate bottom.

3. An injection pump as defined by claim 1, further characterized in that the protrusions comprise tongues that are cut out of the inner wall of the cylindrical cup portion and bent inwardly away from it.

4. An injection pump as defined by claim 1, further characterized in that the spring plate has a radially disposed and outwardly projecting rim portion one side of which forms a support shoulder for the pressure spring.

5. An injection pump as defined by claim 1, further characterized in that the assembly aperture in the spring plate bottom is asymmetrically disposed therein and comprises a central aperture portion having a small internal dimension overlapping an outward aperture portion having a substantially larger internal dimension disposed radially of said central aperture portion, said internal dimensions of said aperture portions being adapted to external dimensions of the annular flange to permit passage therethrough of said annular flange during assembly of said injection pump.

6. An injection pump as defined by claim 1, further characterized in that the pressure plate comprises a diametrically symmetrical washer having a collar, the collar and the washer have first complemental flattened diametrically opposed sides, the washer being additionally provided with second symmetrically flattened diametrically opposed sides disposed at right angles to the first flattened opposed sides, said second flattened opposed sides being spaced apart a distance smaller than said internal radial spacing of the protrusions from one another, said protrusions being disposed diametrically opposite one another and spaced axially from the spring plate bottom a distance greater than a height of the washer and collar as a unit.

7. An injection pump as defined by claim 6, further characterized in that the end of the pressure plate remote from the collar has an integrally formed cylindrical tang an external diameter of which is smaller than said internal radial spacing of the protrusions from one another, and in that the height of the cylindrical tang, washer and collar taken as a unit is greater than the axial spacing of the protrusions from the spring plate bottom.

* * * * *